US005797781A

United States Patent [19]

Yoon

[11] Patent Number: 5,797,781

[45] Date of Patent: Aug. 25, 1998

[54] TRIPLE-LAYERED SHADOW MASK AND ITS MANUFACTURING

[75] Inventor: Sang Youl Yoon, Kyungsangbuk-do, Rep. of Korea

[73] Assignee: Orion Electric Co., Ltd., Kyungsangbuk-do, Rep. of Korea

[21] Appl. No.: 817,599

[22] PCT Filed: Aug. 5, 1996

[86] PCT No.: PCT/KR96/00128

§ 371 Date: Mar. 31, 1997

§ 102(e) Date: Mar. 31, 1997

[87] PCT Pub. No.: WO97/06552

PCT Pub. Date: Feb. 20, 1997

[30] Foreign Application Priority Data

Aug. 4, 1995 [KR] Rep. of Korea ..... 1995/24026(PA)

[51] Int. Cl.[6] ..... H01J 9/18

[52] U.S. Cl. ..... 445/37

[58] Field of Search ..... 445/24, 37

[56] References Cited

U.S. PATENT DOCUMENTS 4,058,875 11/1977 Nubani et al. ..... 445/37
4,107,569 8/1978 Ronde .
4,121,131 10/1978 Van Esdont et al. ..... 445/37
4,341,591 7/1982 Tamutus .
4,443,499 4/1984 Lipp .
4,478,589 10/1984 Takenaka et al. ..... 445/37
4,482,334 11/1984 Ohtake et al. ..... 445/37
4,540,374 9/1985 Kamohara ..... 445/37

FOREIGN PATENT DOCUMENTS 44646 3/1983 Japan ..... 445/37

*Primary Examiner*—Kenneth J. Ramsey
*Attorney, Agent, or Firm*—Notaro & Michalos P.C.

[57] ABSTRACT

A triple-layered shadow mask for a CRT which comprises a first thin metal plate formed in a shape corresponding to a panel with a multiple electron beam holes and supplied with a first DC voltage, a second thin metal plate formed in a shape corresponding to the panel with a multiple electron beam holes and supplied with a second DC voltage for obtaining focus lens between the first and the second DC voltages, and a dielectric layer for forming an insulating layer using the inorganic materials between said first thin metal plate and the second thin metal plate.

3 Claims, 4 Drawing Sheets

TRIPLE-LAYERED SHADOW MASK AND ITS MANUFACTURING

FIELD OF THE INVENTION

The present invention relates to a triple-layered shadow mask for a cathode ray tube(CRT), and more particularly to a triple-layered shadow mask having enlarged apertures or slits and concentrating electron beams, and a method of manufacturing it.

BACKGROUND OF THE INVENTION

Referring to FIG. 1, a color CRT 10 generally comprises an evacuated glass envelope consisting of a panel 12, a funnel 13 sealed to the panel 12 and a tubular neck 14 connected by the funnel 13, an electron gun 11 centrally mounted within the neck 14 and a shadow mask 16 removably mounted to a sidewall of the panel 12. A three color phosphor screen is formed on the inner surface of a display window or faceplate 18 of the panel 12. The electron gun 11 generates three electron beams 19*a* or 19*b*, said beams being directed along convergent paths through the shadow mask 16 to the screen 20 by means of several lenses of the gun and a high positive voltage applied through an anode button 15 and being deflected by a deflection yoke 17 so as to scan over the screen 20 through apertures or slits 16*a* formed in the shadow mask 16.

In the color CRT 10, the phosphor screen 20, as shown in FIGS. 2A and 2B, comprises an array of three fluorescent or phosphor elements R, G and B of three different emission colors arranged in a cyclic order of a predetermined structure of multiple-stripe or multiple-dot shape and a matrix of light-absorptive material surrounding the phosphor elements R, G and B. A thin film of aluminum 22 overlies the screen 20 in order to provide a means for applying the uniform potential applied through the anode button 15 to the screen 20, increase the brightness of the phosphor screen and prevent from degrading ions in the phosphor screen and decreasing the potential of the phosphor screen. And also, a film of resin such as lacquer (not shown) may be applied between the aluminum thin film 22 and the phosphor screen to enhance the flatness and reflectivity of the aluminum thin film 22.

In a photolithographic wet process, which is well known as a prior art process for forming the phosphor screen, a slurry of a photosensitive binder and phosphor particles is coated on the inner surface of the faceplate. It does not meet the higher resolution demands and requires a lot of complicated processing steps and a lot of manufacturing equipments, thereby necessitating a high cost in manufacturing the phosphor screen. And also, it discharges a large quantity of effluent such as waste water, phosphor elements, 6th chrome sensitizer, etc., with the use of a large quantity of clean water.

According to application Ser. No. 817,598, filed Mar. 31, 1997 filed on the same date under the title of "HIGH-LUMINANCE-LOW-TEMPERATURE MASK, CRT HAVING THE MASK AND METHOD OF MANUFACTURING A SCREEN USING THE MASK" by the applicant, a shadow mask 50 as shown in FIG. 3 has been disclosed. The shadow mask 50 comprises a first thin metal plate 51, a dielectric layer 52 and a second thin metal plate 53, being formed in a shape nearly corresponding to a faceplate 18 of a CRT. A multiple electron beam holes 50*a* shaped in minute apertures or slots are formed on the shadow mask 50 in a regular pattern so as to allow the passage of electron beams 19.

In FIG. 2A, the width W of electron beam holes 50*a* is greater than one third of screen pitch SP in case of the stripe-type screen and, in case of dot-type screen, greater than [SW+2(SP−3SW)/3]. Also, the first DC voltage V1 and the second DC voltage V2 are supplied to said first thin metal plate 51 and the second thin metal plate 53 respectively, so that the electron beams 19 passing through the electron beam holes 50*a* may be concentrated in a dimension less than one third of screen pitch SP or [SW+2(SP−3SW)/3]. The concentrating rate is dependent on the voltage difference ΔV between said V1 and V2, and the thickness of the shadow mask 50. For the formation of a focusing lens on the electron beam holes 50*a*, the first thin metal plate 51 and the second thin metal plate 53 are electrically insulated and supplied with two different DC voltages having the voltage difference ΔV respectively, when a dielectric layer 52 is used as an insulator.

However, in case the dielectric layer 52 comprises the organic compounds, it creates a problem of lowering degree of vacuum due to organic gases generated from the the organic compounds in the CRT. Also, in case the dielectric layer 52 comprises the sole inorganic compounds, it creates another problem of breaking down due to high brittleness and low toughness in the process of press-forming the shadow mask into the shape of the panel.

SUMMARY OF THE INVENTION

In order to solve the above problems, an object of the present is to provide a triple-layered shadow mask having enlarged apertures or slits, concentrating the electron beams, generating no organic gas and capable of being formed by press, and a method of manufacturing it.

To achieve the object of the present invention, the present invention provides a triple-layered shadow mask for a CRT which comprises: a first thin metal plate formed in a shape corresponding to a panel with a multiple electron beam holes and supplied with a first DC voltage; a second thin metal plate formed in a shape corresponding to the panel with the same electron beam holes as on said first thin metal plate and supplied with a second DC voltage for obtaining focus lens between the first and the second thin metal plates by means of the first DC voltage and the second DC voltage; and a dielectric layer for forming an insulating layer using the inorganic materials between said first thin metal plate and the second thin metal plate.

Also, the present invention provides a method of manufacturing a triple-layered shadow mask for a CRT, said method comprising the steps of: (a) preparing the first and the second thin metal plates having a multiple electron beam holes in a desired arrangement; (b) mixing inorganic materials and organic materials into a paste by dissolving them with a solvent; (c) producing a triple-layered forming blank by coating either one of said first and the second thin metal plates with said paste and sticking both of the thin metal plates; (d) hardening said paste of said forming blank by drying; (e) forming said forming blank of hardened paste into a given shape; and (f) eliminating said organic materials by burning them out.

DETAILED DESCRIPTION OF THE PREFERRED EMBODIMENT

According to the present invention, a triple-layered shadow mask 50 comprises a first and a second thin plates 51, 53 using the same material as previous one, and a dielectric layer 52 formed between them using inorganic insulating materials which contain alumina chosen from alundum or corundum. Followings are details on a method of manufacturing a triple-layered shadow mask having the dielectric layer 52 of the inorganic insulating materials.

Figure 1:
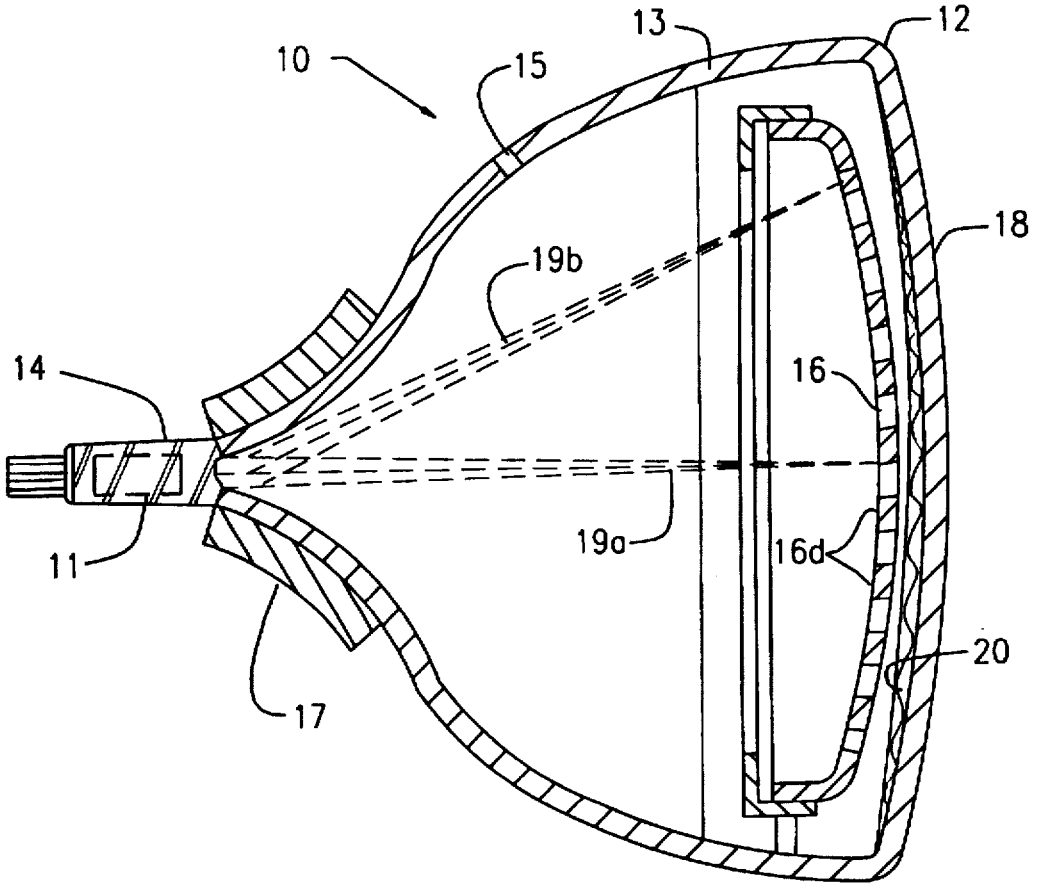
FIG. 1 is a plan view partially in axial section of a color cathode ray tube.
Figure 2A:
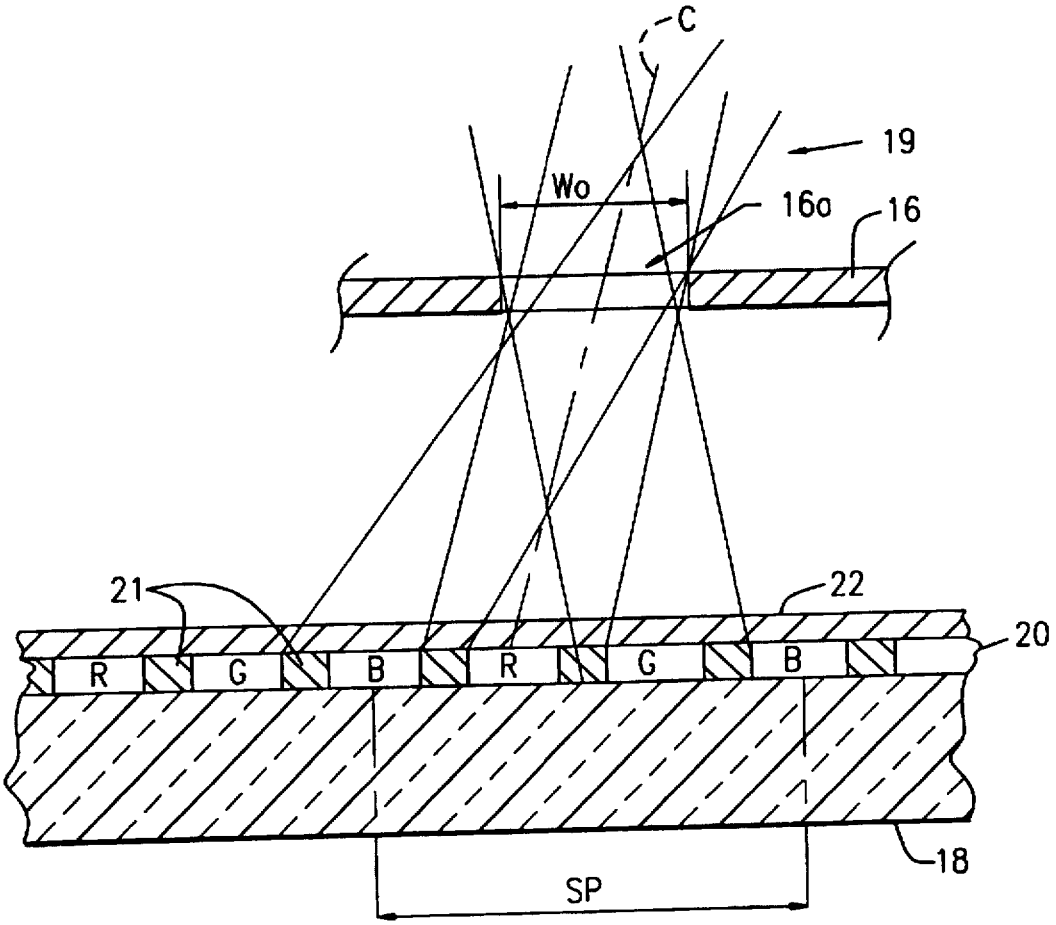
FIGS. 2A and 2B are a partial sectional view of a stripe-type screen and a partial enlarged plan view of a dot-type screen respectively.
Figure 2B:
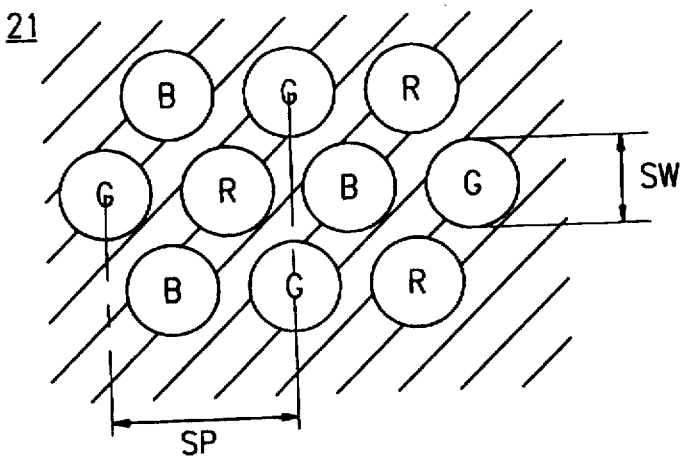
Figure 3:
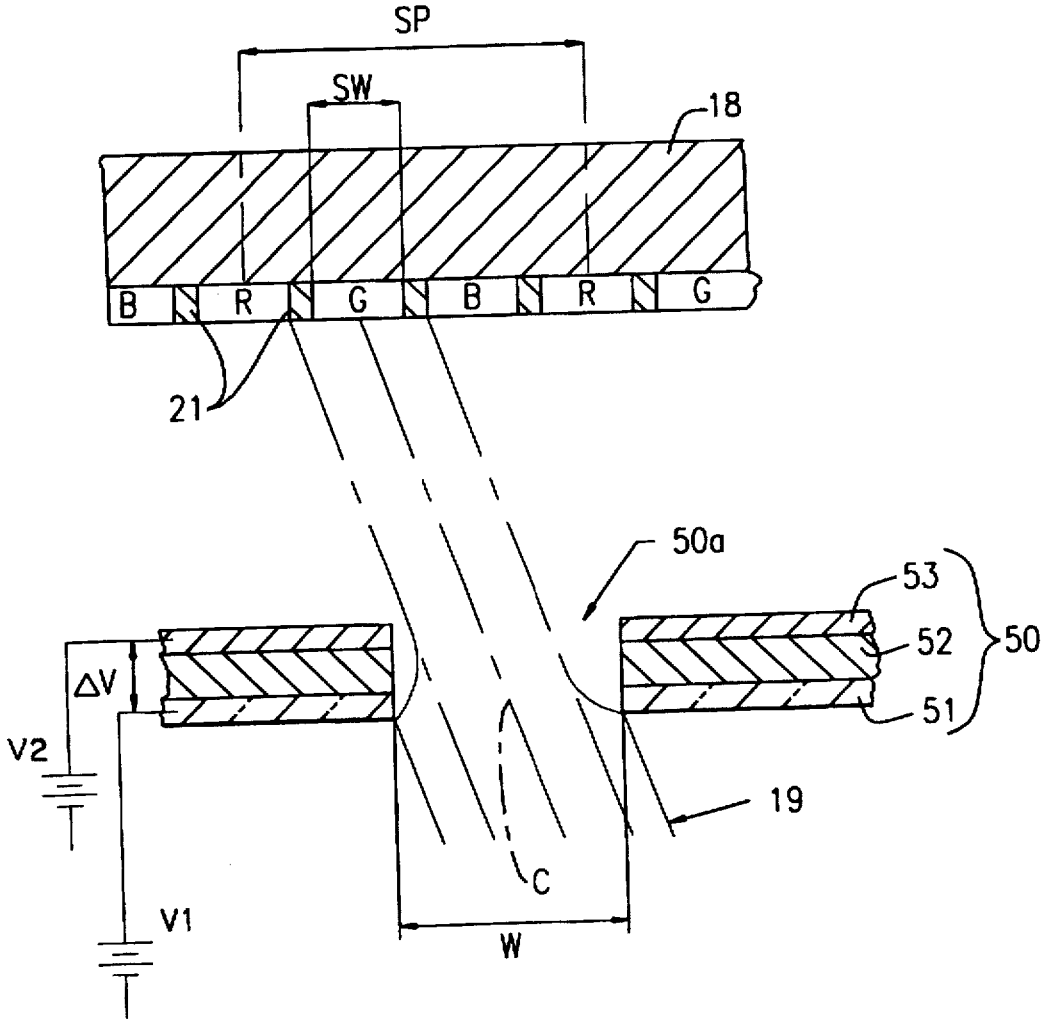
FIG. 3 is a partial enlarged sectional view of a stripe-type screen to show the structure of a triple-layered shadow mask according to the present invention.
Figure 4A:
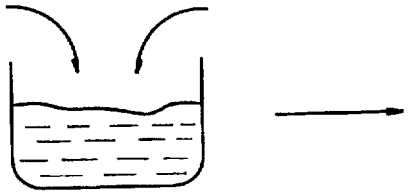
FIGS. 4A through 4E show various steps in manufacturing a triple-layered shadow mask according to the present invention.

Referring first to FIG. 4A showing a mixing step, fine powder of the inorganic insulating materials such as alundum or corundum and fine powder of the organic materials such as polyisoprene rubber or polybutene rubber are mixed and dissolved by a solvent of toluene, thereby making a paste.

Figure 4B:
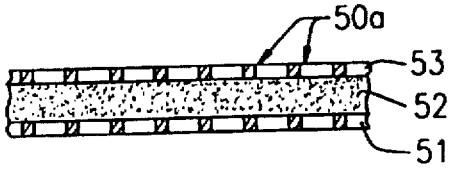

Referring to FIG. 4B showing a coating step, a multiple electron beam holes are arranged desirably on the first and the second thin metal plates 51, 53, either one of which is coated with said paste and sticked to other thin metal plate to form a forming blank with their electron beam holes 50*a* coincided.

Figure 4D:
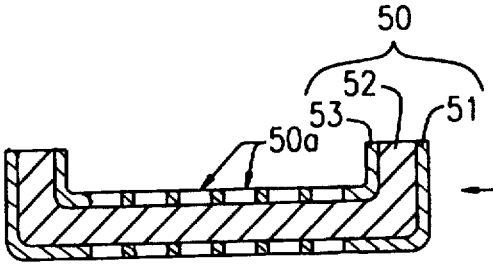
Figure 4C:
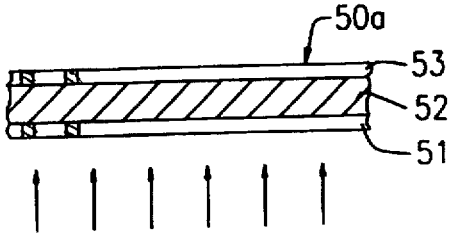

Thereafter, at the hardening step of FIG. 4C, said coated paste gets hardened by drying the forming blank. Thus, the elastic organic materials contained in the dielectric layer 52 of a hardened paste provide enough bonding strength and elasticity to keep the forming blank from being broken while being formed into a given shape at the forming step of FIG. 4D, and to form an insulating layer between the first and the second thin metal plates 51, 53.

Figure 4E:
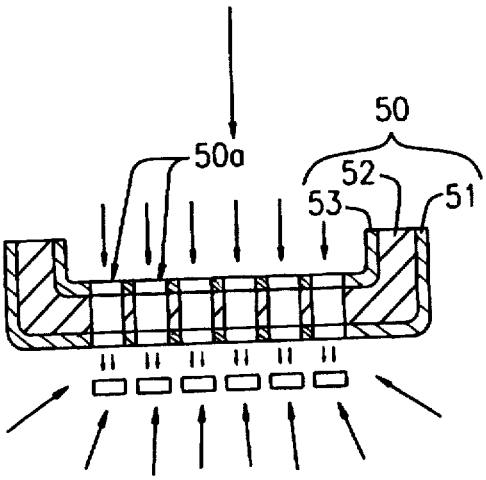

Than, the triple-layered shadow mask 50 is heated over 250°–350° C., burning temperature of said organic materials, at the burning step of FIG. 4E so that the organic materials in said dielectric layer 52 can be burned and evaporated. Meanwhile the inorganic insulating materials positioned at the electric beam holes 50*a* lose its bonding strength and can be removed out of the electric beam holes 50*a*.

However, the other inorganic insulating materials than positioned at the electric beam holes 50*a* can be sustained by the walls of the first and the second thin plates 51, 53 even after the organic materials are removed out of said dielectric layer 52.

Also, instead of the burning step of FIG. 4E, another step contacting a triple-layered shadow mask 50 with a solvent is applicable so that the organic materials of a dielectric layer 52 positioned at the electric beam holes 50*a* can be dissolved and the inorganic insulating materials lose its bonding strength, thereby forming the electric beam holes 50*a* on the dielectric 52. Thereafter, the remaining organic materials of the dielectric layer 52 positioned at other places than the electric beam holes 50*a* is burned out and eliminated at the STABI process for removing a welding stress and a residual stress of a frame assembly, or at the FRIT process for sealing a panel and a funnel.

Thus, the organic materials are completely removed from the triple-layered shadow mask 50 of this invention, thereby preventing the generation of any organic gas during operation in an evacuated state.

According to the method of manufacturing a triple-layered shadow mask of the present invention, the dielectric layer is endowed with enough elasticity and ductility to endure the stress only during forming process, and the resultant dielectric layer is made of the sole inorganic insulating materials, thus the shadow mask can be press-formed without any organic gas occurred.

Although the invention has been described in its preferred form with a certain degree of particularity, it is to be understood that the combination and arrangement of parts may be resorted to without departing from the spirit and the scope of the invention as hereinafter claimed.

What is claimed is:

1. A method of manufacturing a triple-layered shadow mask for a CRT, said method comprising the steps of:

(a) preparing a first and a second thin metal plates having a multiple electron beam holes in a desired arrangement;

(b) mixing inorganic materials and organic materials into a paste by dissolving them with a solvent;

(c) producing a triple-layered forming blank by coating either one of said first and the second thin metal plates with said paste and sticking both of the thin metal plates;

(d) hardening said paste of said forming blank by drying them;

(e) forming said forming blank of hardened paste into a given shape; and (f) eliminating said organic materials by burning them out.

2. The method of manufacturing a triple-layered shadow mask for a CRT as claimed in claim 1, wherein, at the mixing step, said inorganic materials are alumina chosen from the group consisting of alundum, corundum and mixture of them, said organic materials are selected from the group consisting of polyisoprene rubber and polybutene rubber, and said solvent is toluene.

3. A method of manufacturing a triple-layered shadow mask for a CRT comprising the steps of:

(a) preparing first and second thin metal plates, each having a multiplicity of electron beam holes in a desired arrangement;

(b) mixing inorganic materials and organic materials into a paste by dissolving them with a solvent;

(c) producing a triple-layered forming blank by coating either one of said first and second thin metal plates with said paste and sticking both the thin metal plates together;

(d) hardening said paste of said forming blank by drying;

(e) forming said forming blank of hardened paste into a given shape to make a triple-layered shadow mask; and (f) dissolving out said organic materials from the multiplicity of electron beam holes by contacting the triple-layered shadow mask formed in step (e) with a solvent;

wherein at the mixing step, said inorganic materials are alumina chosen from the group consisting of alundum, corundum and a mixture of alundum and corundum, said organic materials are selected from the group consisting of polyisoprene rubber and polybutene rubber, and said solvent is toluene.

* * * * *